US005271625A

United States Patent [19]

Kurtz et al.

[11] Patent Number: 5,271,625

[45] Date of Patent: Dec. 21, 1993

[54] FLEXIBLE POINT DART

[75] Inventors: Ronald Kurtz, Englewood; Gaetano Mariella, Wayne; Henry Utzinger, Ridgewood, all of N.J.

[73] Assignee: Kulite Tungsten Corporation, East Rutherford, N.J.

[21] Appl. No.: 949,391

[22] Filed: Sep. 22, 1992

[51] Int. Cl.[5] ..... A63B 65/02

[52] U.S. Cl. ..... 273/420

[58] Field of Search ..... 273/416, 417, 420; 362/139

[56] References Cited

U.S. PATENT DOCUMENTS

| | | | |
|---|---|---|---|
| 4,840,383 | 6/1989 | Lombardo | 273/420 |
| 5,003,437 | 3/1991 | Barrett | 362/109 |
| 5,134,552 | 7/1992 | Call et al. | 362/109 X |

FOREIGN PATENT DOCUMENTS

| | | | |
|---|---|---|---|
| 2180461 | 4/1987 | United Kingdom | 273/419 |
| 2224452 | 5/1990 | United Kingdom | 273/419 |

OTHER PUBLICATIONS

Van Nostrand's Scientific Encyclopedia, Fourth Edition pp. 1024, 1025, Mar. 1970, Liquid Crystals.

*Primary Examiner*—Paul E. Shapiro

*Attorney, Agent, or Firm*—Arthur L. Plevy

[57] ABSTRACT

A dart point for a game dart fabricated from a resin reinforced composite laminate wherein the dart point deflects around a metal rib on a dartboard when the dart point strikes the metal rib at a point off-center. Furthermore, the dart point destructively deforms when the dart point strikes the direct center of a metal rib on the dartboard, thereby changing the point of contact between the dart point and the wire so as to direct the dart point into the dartboard at the side of the metal rib contacted.

17 Claims, 4 Drawing Sheets

FLEXIBLE POINT DART

FIELD OF THE INVENTION

The present invention relates to game darts, such as those used in conjunction with a dartboard in games of skill, and more particularly to such game darts that have points formed from a flexible and selectively deformable material thereby allowing the dart point to deflect into the dartboard when the dart strikes one of the wires used to define various regions on the dartboard.

BACKGROUND OF THE INVENTION

The game of darts, wherein a player throws darts at target areas of a dartboard, is played throughout the world as a competitive contest. The dartboards commonly used in tournament level play are constructed from a penetrable material such as jute, cork, sisal fiber or the like so as to permit the metal point of a typical dart to pierce the board and be held in place by the board material. The target surface of such tournament level dartboards often incorporate a plurality of metal ribs, which are used to define the limits of various target areas on the dartboard. The metal ribs are commonly fabricated from steel wire of a diameter between one and two millimeters. Typically a dartboard is divided into twenty equal pie-shaped areas and include a plurality of concentric rings, which are superimposed across the pie-shaped areas. Both the concentric rings and the edges of the pie-shaped areas are formed from the metal ribs. As such, a significant portion of the dartboard is covered by the metal ribs. Hence, players often strike a metal rib with darts during the course of play. The contact of the dart point against the metal rib causes the dart to bounce off the board and fall to the ground. Consequently, the dart point, barrel, or flight elements of the dart may be damaged, and the player receives no points for the "bounce-out".

The prior art has addressed the problem of darts bouncing off the metal ribs of a dartboard by providing darts having a rigid metal dart point connected to the dart barrel in a flexible manner. In such prior art darts, a metal dart tip may be affixed to a dart barrel within a base of elastomeric material, thereby allowing the metal dart point to move relative the dart barrel. Similarly, in the prior art, springs have been used to connect metal dart points to dart barrels, thereby providing flexibility to the dart point. An example of a prior art dart having such features is shown in U.S. Pat. NO. 4,101,126 to Kurtz et al. entitled GAME DARTS AND DARTBOARDS EMPLOYING ANTI-BOUNCE-OFF APPARATUS and assigned to Kulite Tungsten Corporation, the assignee herein.

Prior art darts that utilize elastomeric materials or springs in association with metal points allow the dart point of the dart to axially deform relative to the dart barrel when the dart point strikes a metal rib on a dartboard. The deflection of the dart point enables it to circumvent the contacted metal rib and engage the dartboard material at the side of the metal rib. However, in using such prior art darts, the metal dart points must be affixed to either a spring, a base of elastomeric material, or flexible support. Such assemblies require specialized dart barrels that are adapted to properly receive the spring or elastomeric material. Since the metal dart points of many prior art darts are mounted within a base of elastomeric material or are mounted to springs, the dart points of such prior art darts are often not free to rotate independently of the dart barrel to which they are attached. When a dart is thrown, the spin of the thrower's hand and/or the orientation of the flight elements on the dart often cause the dart to spin during its flight. As such, there exists a torsional momentum in the dart point as it strikes the dartboard. If the dart point strikes a metal rib on the dartboard, the torsional momentum causes the dart point to attempt to bore into the metal rib. As such, the torsional momentum contained within the thrown dart counteracts the ability of the dart point to deflect and circumvent a contacted metal rib.

In the prior art, there also exists examples of darts formed with dart points of soft material such as plastic and are therefore considered "flexible". Plastic point darts are used primarily for electronic dart games, where those boards are not bristle and have a plurality of apertures. Plastic point darts are often manufactured with points that are shorter and thicker than conventional metal points, thereby helping the plastic point to better withstand forces incurred during the game of darts. Prior art plastic point darts have many disadvantages when compared to conventional metal pointed darts. Since darts with plastic points tend to have shorter and thicker point configurations, such plastic point darts can not form as tight of a grouping on the dartboard during the game of darts. Plastic point darts tend to break during play. Plastic pointed darts also bend easily causing the dart point not to remain concentric with dart barrel. Additionally, darts with plastic points tend to wiggle or shake immediately proceeding contact with the dartboard, as the weight of the dart barrel becomes supported by the plastic point. The wiggle of the plastic pointed dart can cause other closely grouped darts to be knocked out of the dartboard.

To reduce the forces incurred by a plastic point, and to reduce the darts tendency to shake on the dartboard, darts with plastic points tend to be manufactured with much lighter dart barrels than are conventional metal pointed darts. Consequently, the advantages of balance and performance achievable through the heavier metal point darts are lost in the prior art embodiments of plastic pointed darts.

It is, therefore, a primary objective of the present invention to provide a dart with a dart point fabricated from a material that is flexible enough to circumvent a contacted metal rib on a dartboard yet is rigid enough to support a conventionally weighted dart barrel without significantly wiggling or shaking upon impact with the dartboard.

It is a further object of the present invention to provide a such a dart point having the same length as conventional metal dart points wherein the dart point will remain concentric with the dart barrel and will not bend or break during the course of play or if the dart is dropped onto a hard surface.

It is yet a further object of the present invention to provide such a dart point in low cost and readily manufacturable manner.

SUMMARY OF THE INVENTION

The present invention dart includes a dart point formed from a material with an inherent amount of flexibility, thereby allowing the dart point to deflect to the side of the a metal rib on a dartboard should the dart point strike the metal rib during the course of a game of darts. The dart point of the present invention dart is preferably formed from a resin reinforced composite structure which provides the dart point with the flexibility needed to deflect to the side of a contacted metal rib. However, the dart point's construction provides enough rigidity to allow the dart point to pierce, and be retained within, the material of a conventional tournament dartboard without significant movement upon impact. The dart point is formed in the shape and length of common metal dart points, and can be used with a weighted dart barrel typical of metal pointed darts.

In the preferred embodiment of the present invention, the dart point is formed to destructively yield should the dart point strike the apex in the center of a metal rib. By yielding, the point of contact between the dart point and the metal rib change, thereby allowing the dart point to be directed into the material of the dartboard on the side of the metal rib originally contacted. The destructive yielding of the dart point prevents the dart from bouncing-off the dartboard should the dart point strike the exact center of a metal rib on the dartboard. The dart point on the present invention dart is therefore formed to be readily replaceable so that worn dart points can be replaced and the dart reused.

BRIEF DESCRIPTION OF THE DRAWINGS

For a better understanding of the present invention, reference is made to the following description of an exemplary embodiment thereof, considered in conjunction with the accompanying drawings, in which.

BRIEF DETAILED DESCRIPTION OF THE FIGURES

Figure 1:
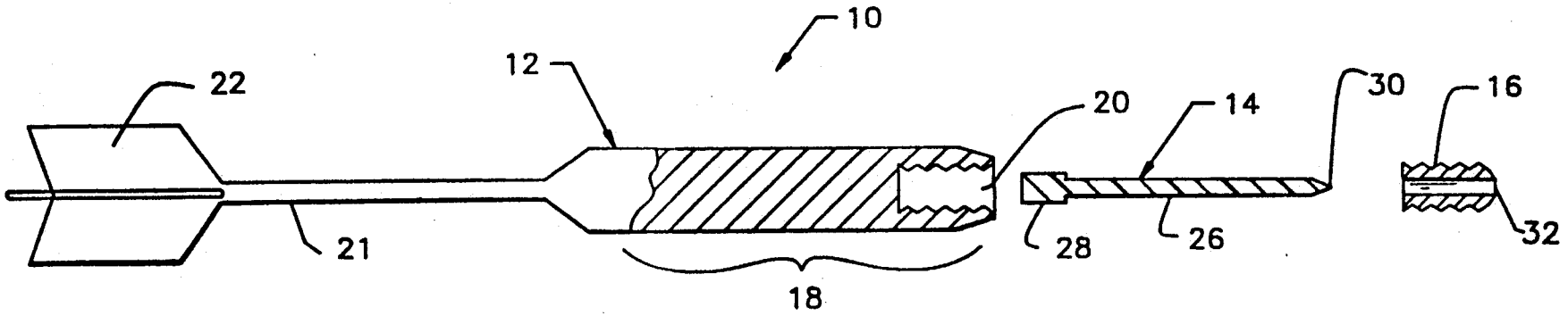
FIG. 1 is an exploded side cross-sectional view of a game dart formed in accordance with one preferred embodiment of the present invention.

Referring to FIG. 1, there is shown a preferred embodiment of the present invention dart 10 comprised of a barrel assembly 12, a dart point 14, and a threaded collet 16. The barrel assembly 12 is typical of that utilized in the prior art, having a weighted gripping region 18, a tail region 21 and flight elements 22 extending from a distal end of the tail region 21. Formed into the proximal end of the gripping region 18, opposite the tail region 21, is a threaded aperture 20. The aperture 20 is concentrically aligned with the longitudinal axis of the dart 10. The aperture 20 is sized to receive the dart point 14 and the collect 16, whereby the collet 16 threadably attaches to the aperture 20, retaining the dart point 14 into a set position.

In the embodiment of FIG. 1, the dart point 14 contains a shaft 26 terminating at one end with an enlarged head 28 and terminating at the opposite end at a tapered tip 30. The enlarged head 28 of the dart point 14 is passed into the aperture 20 of the barrel assembly 12. The tapered tip 30 of the dart point 14 is then passed through the central hollow 32 of the collet 16. The diameter of the central hollow 32 of the collet 16 is slightly larger than the diameter of the dart point shaft 26. As such, when the collet 16 is joined to the barrel assembly 12, the dart point 14 is free floating and maintains its ability to rotate independently of both the barrel assembly 10 and the collet 16. As will be recognized by a person skilled in the art, the use of the collet 16 to hold the dart point 14 in the threaded aperture 20 of barrel assembly 12 allows the dart point 14 to be readily replaced without effecting the other components of the dart 10.

Figure 2:
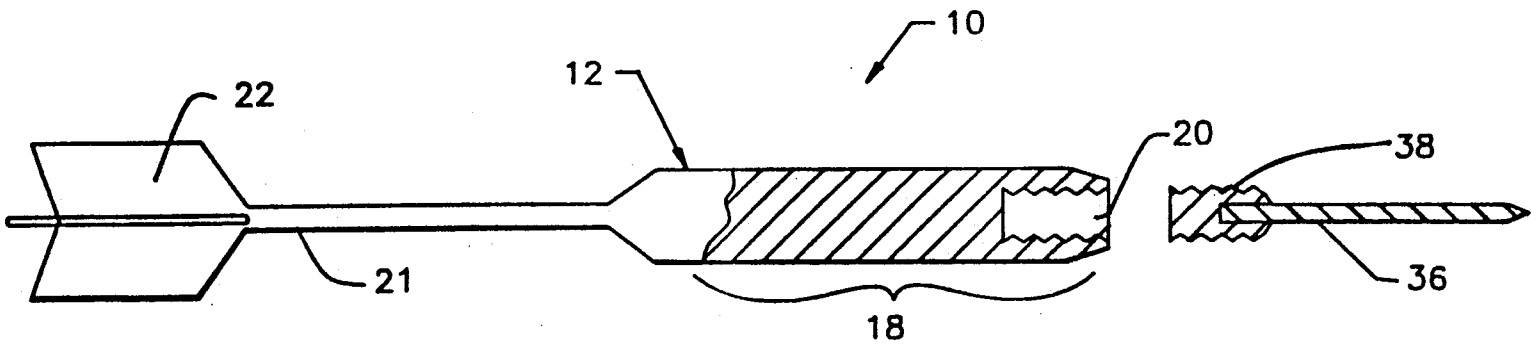
FIG. 2 is a side cross-sectional view of a game dart formed in accordance with an alternate embodiment of the present invention.

In FIG. 2, there is shown an alternative embodiment of the present invention point assembly 34, wherein a dart point 36 is press fit into a threaded base 38. The barrel assembly 12 shown is identical to the barrel assembly 12 of FIG. 1, as such like parts retain the same reference. The threaded base 38 of the point assembly 34 engages the aperture 20 within the barrel assembly 12, thereby affixing the dart point 36 to barrel assembly 12.

In the prior art there exists many barrel assemblies formed such as the barrel assembly 12 of FIGS. 1 and 2. As such, it should be understood that the dart point 14 or the point assembly 34 can be readily assembled to many existing barrel assemblies 12 to form the present invention dart.

Figure 3:
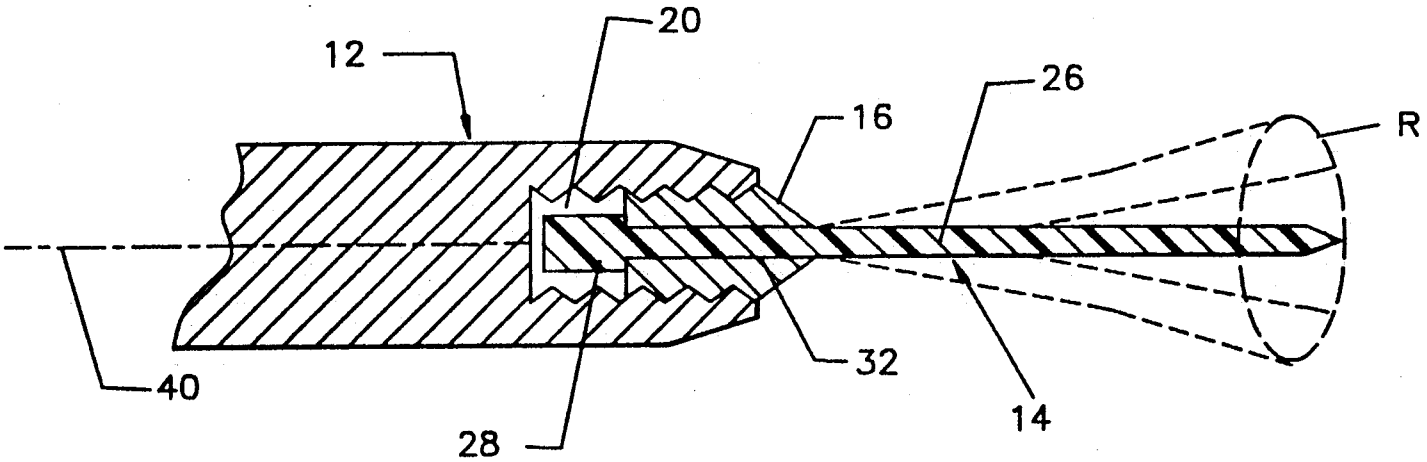
FIG. 3 is a partial cross-sectional view of the dart point and barrel assembly corresponding to the preferred embodiment of FIG. 1.

Referring to FIG. 3, there is shown a partial cross-sectional view of the preferred embodiment of the present invention dart, shown in FIG. 1. As can be seen, the shaft 26 of the dart point 14 passes through the central hollow 32 of the collet 16, thereby affixing the dart point 14 to the barrel assembly 12. In the prior art, the points of various darts are formed from metal and the flexibility of the dart point was provided by mounting the metal dart point in a manner enabling it to flex or pivot. In the present invention the dart point 14 is formed from a resin reinforced composite structure that provides the dual aspect of rigidity to the dart point 14 as needed to effectively function as a dart, and the inherent flexibility. In FIG. 3, it can be seen that the dart point 14 is nominally maintained along the longitudinal axis 40 of the dart 10, yet the material of the dart point 14 itself allows the dart point 14 to deform through range R. The range R, as shown, is exaggerated for the purposes of illustration. As will be later explained it is desirable to have a dart point 14 that is capable of deflecting a distance equivalent to half the width of a dartboard wire in any direction. As such, it should be understood that the radius of the shown range R is preferably equal to one-half the diameter of a typical dartboard wire.

Figure 4A:
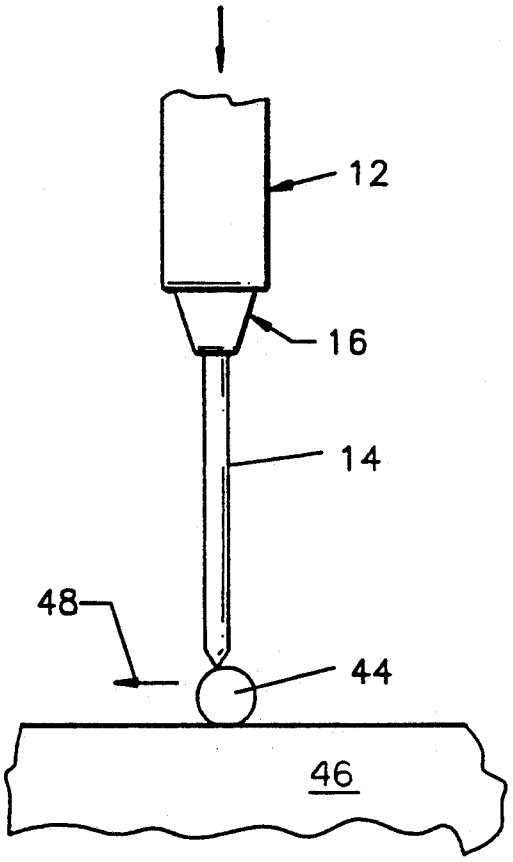
FIG. 4*a* and 4*b* a partial cross-sectional view of a dart point and barrel assembly shown in conjunction with a cross-sectional fragment of a dartboard to facilitate consideration and discussion.
Figure 4B:
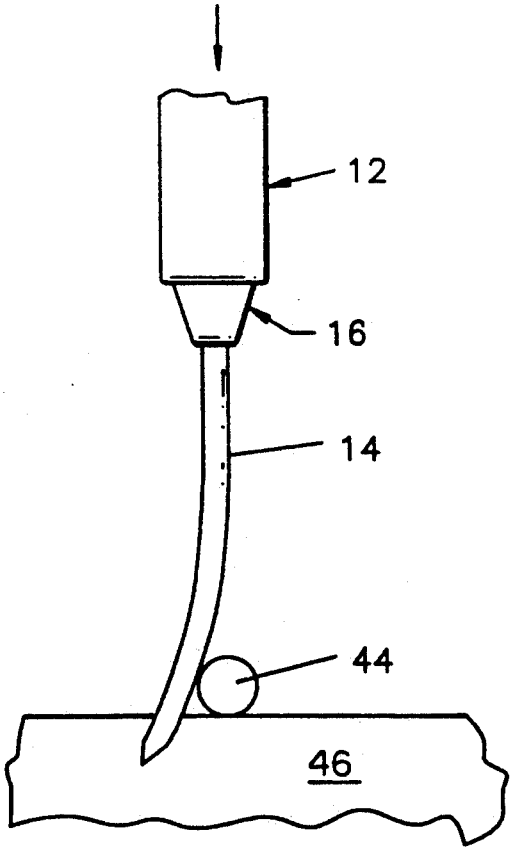

During a game of darts, darts often contact the metal ribs present on the dartboard used to define differing target areas on the dartboard. Typically, the metal ribs used are round metal wires but can be of other cross-sectional configurations as well. As such, when a dart strikes one of the metal wires, the dart point either contacts the rounded sides of the metal wire or the dart will strike flush in the center of the wire at the apex of the wire's curvature. Referring to FIG. 4*a*, there is shown a dart 10 as it would appear during a game of darts, wherein the dart point 14 is striking the side of a metal wire 44 positioned atop a dartboard 46. Since the dart point 14 is striking the side of the metal wire 44, the dart point 44 is deflected away from the metal wire 44 by the curvature of the wire 44. The deflection force, created by the impacted curved surface is shown as arrow 48. The deflection force created by the curved surface acts to deform the dart point 14. Referring to FIG. 4*b* it can be seen that the deflecting force causes the dart point 14 to deform around the metal wire 44 and pierce the dartboard 46 on the side of the metal wire 44 originally contacted. As has been previously mentioned, the dart point 14 is preferably formed from a resin reinforced composite structure. The material of the dart point 14 allows the dart point 14 to deflect in any direction a distance equal to at least one half the diameter of the metal wire 44. As such, the material of the dart point 14 would allow the dart point 14 to deflect to the side of the metal wire 44, independently of the position where the dart point 14 actually contacted the metal wire 44. Furthermore, the material of the dart point 14 provides the dart point 14 with the rigidity needed to pierce, and be retained within, the material of the dartboard 46 without substantial movement upon impact. This is the case even though the dartboard 46 is made of materials adapted to receive metal pointed darts.

There are many materials such as plastic and the like which exhibit a relatively high degree of flexibility as compared to the metals typically used in dart points. However, in order to avoid the certain disadvantages, the material used in the present invention dart must contain many characteristics other than flexibility that are commonly not associated with plastics. In order for the present invention dart 10 to be used in a game of darts with a conventional dartboard 46, the dart point 14 must maintain a certain minimum rigidity. The rigidity of the dart point 14 must allow the tapered point 30 of the dart point 14 to penetrate the material of the dartboard 46 with a sufficient depth to support the weight of a conventionally weighted dart barrel. Conventionally weighted dart barrels used with metal points are typically between nineteen and thirty five grams. The rigidity of the material of the dart point 14 must be enough to both support the weight of the dart barrel 12 at a perpendicular to the dartboard 46 without the bowing of the dart point 14 once the dart point 10 has engaged the dartboard 46. Furthermore, the rigidity of the dart point 14 must be high enough to prevent the tendency of the dart barrel 12 to wiggle or sway relative the dart board 46 as the dart point 14 impacts the dartboard 46. The rigidity of the dart point 14 should also resist non-elastic deformation should the dart 10 miss the dartboard 46 or bounce off the dartboard 46 and strike the ground.

Besides rigidity, the present invention dart point 10 must have physical dimension close to that of conventional metal point darts. As such, darts 10 that include the present invention dart point 14 can be thrown in tight groups on the dartboard 46 that are similar in size to those achievable with conventional metal point darts. The present invention dart point 14 must also have a material hardness that allows the dart point 14 to withstand repeated impacts with the dartboard 46 without the need for replacement or sharpening. In the preferred embodiment, the tapered point 30 of the present invention dart point 14 should be able to withstand at least fifty games of darts before replacement or sharpening is warranted.

In the prior art, many darts are designed to circumvent metal wires on dartboards by utilizing the curved geometry of the side surfaces of the metal wires to create a deflecting force. A unresolved problem within the prior art occurs when a prior art dart point strikes the center of a metal wire at its apex and no deflecting force is created. In such situations, the prior art darts bounce off the dartboard, because no deflecting force is created by the dynamics of the impact. In the present invention dart 10, the dart point 14 is made of a resin reinforced composite structure that destructively deforms when the tapered tip 30 of the dart point 14 strikes flush against the center of a metal wire 44. Referring to FIG. 5*a* there is shown the present invention dart 10 as it strikes in the center of a metal wire 44. As can be seen, there exists no deflecting forces created by the geometry of the metal wire 44, as such there exists no deflecting forces that can be used to deflect the dart point 14 and make it circumvent the metal wire 44. Since no deflecting forces are formed, the kinetic energy of the dart 10 is directly absorbed by the tapered tip 30 of the dart point 14. As a consequence of the absorbed kinetic energy, the tapered tip 30 destructively deforms.

Figure 5C:
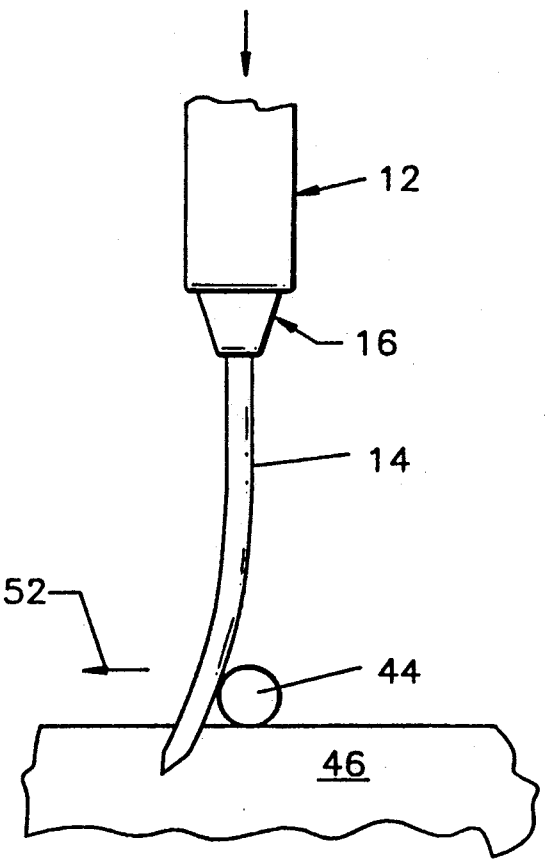
FIGS. 5*a*, 5*b*, and 5*c* are partial cross-sectional views of a dart point and barrel assembly shown in conjunction with a cross-sectional fragment of a dartboard to facilitate consideration and discussion.
Figure 5B:
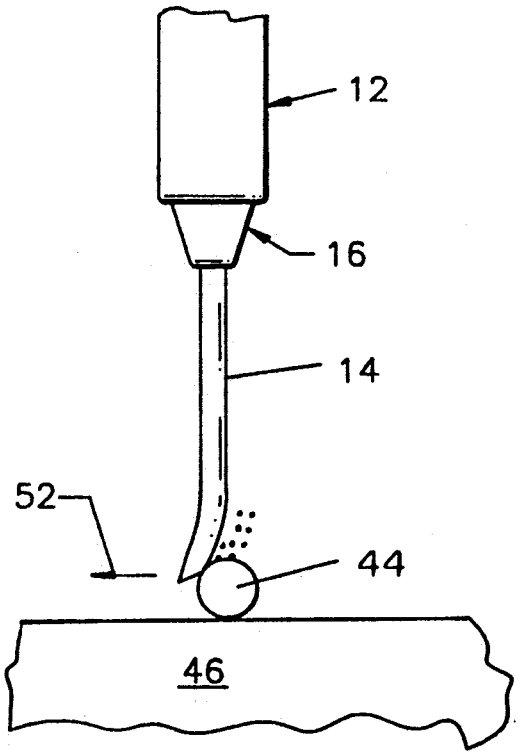
Figure 5A:
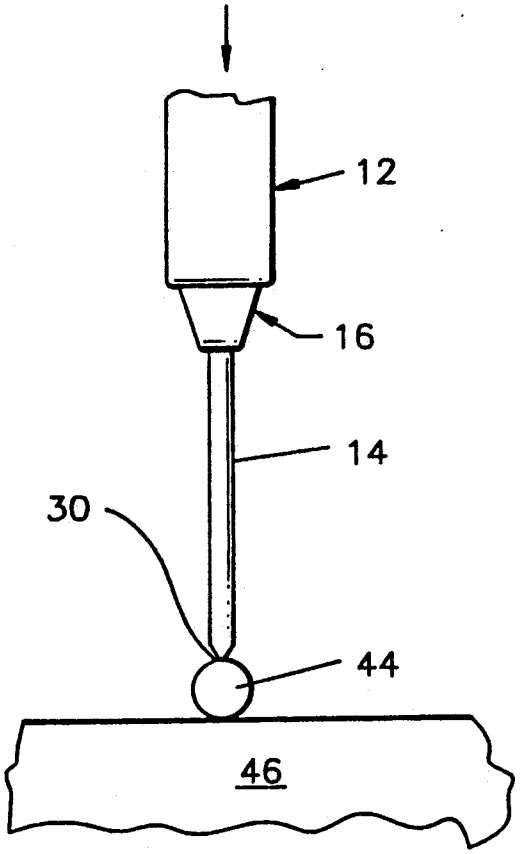

Referring to FIGS. 5*b* and 5*c* the present invention dart 10 is shown wherein the tapered tip 30 struck and destructively deformed against a metal wire 44. The dart point 14 of the present invention dart 10 is formed from a resin reinforced composite structure. As will be later be explained the dart point 14 can be formed from a resin reinforced composite laminate material, a polymer-matrix composite material or fiber-reinforced thermoplastics utilizing liquid crystal polymers. Each of the above materials tend to yield along lamination lines as the materials are impacted with a sufficient destructive force. When the dart point 14 strikes the apex of a metal wire 44 during a game of darts, the kinetic energy absorbed by the tapered point 30 is sufficient to destructively deform the material of the dart point 14. As can be seen from FIG. 5*b*, the dart point 14 destructively yields by either blunting or having small fragments break away from the tapered point 30.

As a result of the destructive yielding of the dart point 14, the dart point 14 no longer contacts the metal wire 44 solely at this apex of curvature. Rather, the deformation of the dart point 14 causes the dart point 14 to move away from the apex of the metal wire 46 and contact a side surface of the metal wire 44. As such, deflecting forces are formed, as shown by arrow 52. The deflecting forces then deflect the dart point 14 to one side of the metal wire 44 where it pierces, and becomes embedded within, the material of the dartboard 46. To reuse the dart 10, the dart point 14 is removed from the dart 10 and replaced or resharpened to a new point. The dart 10 can thereby be used again until the tapered tip 30 of the dart point 14 again destructively deforms against a metal wire 44 on the dartboard 46.

In the present invention dart 10, the dart point 14 is made of a resin reinforced composite structure that is flexible enough to deflect around the sides of a round metal wire. Several materials embody the physical characteristics needed by the present invention dart point 14. In the preferred embodiment the dart point is preferably from a National Electrical Manufactures Association (NEMA) grade FR-4 composite laminate having an epoxy resin and a glass reinforcement structure. When formed into a dart point 14, NEMA FR-4 material has the needed flexibility to deflect the distance of at least half the diameter of a contacted metal wire 44 on a dartboard 46. Furthermore, NEMA FR-4 material has the needed rigidity to support the full weight of a conventional dart and withstand the forces incurred in a regular game of darts as the dart impacts the dartboard 46 or falls to the ground. Lastly, NEMA FR-4 material is brittle enough to destructively deform when the dart point impacts against the apex of a metal wire 44.

NEMA FR-4, is not the only material that embodies the needed characteristics when formed into a dart point 14. However, NEMA FR-4 is a readily available, relatively inexpensive material that can easily be machined into the needed shape of a dart point 14. Composite laminate materials that can be used in place and stead of the NEMA FR-4 include, but are not limited to NEMA G-5, NEMA G-9, NEMA G-10 and NEMA G-11 grade composite laminates having either epoxy or melamine based resins and glass fiber reinforcements. Besides having the needed physical properties of flexibility and rigidity, the above-listed composite laminate materials share the ability to destructively yield when those materials are formed into a dart point 14 and that dart point impacts the center of a metal wire on a dartboard. Typically, the above-listed composite laminate materials are manufactured with laminate layers of approximately 0.015 inches in width, however, it should be understood that other laminate thicknesses may be used. Consequently, the dart point 14 formed form such materials is prone to yielding at points every 0.015 inches across the diameter of the dart point 14. Since the impact of dart point 14 against the metal wire 44 unevenly stresses the various lamination within dart point 14, the dart point 14 destructively yields in a nonuniform manner, thereby deflecting the advancing force of the thrown dart 10 to one side of the metal wire 44 or the other. Consequently, the yielding of the dart point 14 against the metal wire 44 changes the point of contact between the dart point 14 and the metal wire 44 causing the dart point 14 to be deflected to one side of the metal wire 44 and into the dartboard 46. The plastic selected is a thermoset and the following characteristics are of particular concern. The selected plastic points provide better holding characteristics in a bristle type board providing increased adhesion to the sisal fibers in the board.

It should be understood that the embodiments specifically described above are merely exemplary and alternative embodiments can be formed by a person skilled in the art by modifying various described components. For example, in FIGS. 1 and 2 two different embodiments are shown, each disclosing a different way to connect the dart point to the dart. As has been described, the dart point of the present invention dart may destructively deform should it contact a metal wire on a dartboard. As such, it should be understood that dart point must be readily replaceable on the dart. Consequently, it should be understood that any known attachment means can be used in attaching the present invention dart point to a dart and the present invention should not be limited to the embodiments specifically described.

Furthermore, it should be understood that the materials listed for use in the present invention dart point are also merely exemplary and were set forth merely to represent the best known mode of the present invention and to enable a person skilled in the art to make the same. However, other more expensive materials may also be used. For example, fiber reinforced polymer-matrix composites (PMCs) such as high modules graphite reinforced polyamide and high-modules reinforced epoxy PMCs may also be used. Such PMCs contain the flexibility needed of the present invention dart point and also contain a laminate structure that allows for the needed yielding upon impact with a metal wire. In addition to PMCs, fiber-reinforced thermoplastics with selected liquid-crystal polymer resins can also be adapted to the present invention dart point. It should, therefore, be understood that the materials specifically described are exemplary and a material may be used provided that that material has the needed flexibility, hardness, rigidity and yielding characteristics previously described. Based on tests concerning the dart of the present invention and other darts providing antibounce features, it was decided that this particular dart was far superior and provided much less bounce out than commercially available darts which provide the no bounce feature as for example described in the background of the invention.

It is therefore understood that variations and modifications maybe made in the construction of the present without departing from the spirit and scope of the invention. All such variations and modifications are intended to be included within the scope of this invention as defined by the appended claims.

What is claimed is:

1. A dart for use in a game of darts wherein said dart is thrown at a desired target area of a dartboard as defined by at least one round wire present on the surface of said dartboard, said dart comprising:

a barrel portion having a point accommodating end and a flight accommodating end; and a dart point removeably affixed to said point accommodating end, said dart point including a reinforced composite laminate, wherein said dart point deflects to one side of said wire when said dart point strikes said wire at a point off-center, and said dart point desructively yields when said dart point strikes said wire on-center, whereby said dart point yields in such a manner that directs said dart point from said wire and into said dartboard.

2. The dart according to claim 1, wherein said dart point is capable of deflecting a distance equal to one half the width of said wire when said dart point contacts said wire at said point off-center.

3. The dart according to claim 1, wherein said dart point is non-metallic.

4. The dart according to claim 1, wherein said dart point is free to rotate independently of said barrel portion.

5. The dart according to claim 1, wherein said reinforced composite laminates includes resin reinforced composite laminates.

6. The dart according to claim 5, wherein said resin reinforced composite laminates include NEMA FR-4, NEMA G-5, NEMA G-9, NEMA G-10 and NEMA G-11 composite laminates.

7. In a dart for use in a game of darts, a dart point capable of destructively deforming when striking the center of a wire present on a dartboard, thereby allowing said dart point to be directed from said wire into said dartboard, wherein said dart point includes a composite laminate.

8. The dart point according to claim 7, wherein said dart point elastically deforms to one side of said wire when striking said wire at a point off-center.

9. The dart point according to claim 7, wherein said point is non metallic.

10. The dart point according to claim 7, wherein said composite laminates include resin reinforced composite laminates.

11. The dart point according to claim 10, wherein said resin reinforced composite laminates include NEMA FR-4, NEMA G-5, NEMA G-9, NEMA G-10 and NEMA G-11 composite laminates.

12. The dart for use in a game of darts, wherein said dart is thrown at a dartboard defined into target regions by at least one wire, said dart having a selectively removable dart point formed from a laminated resin reinforced composite material.

13. The dart according to claim 12, wherein said dart point elastically deflects on said dart a distance equivalent to one half the width of said wire.

14. The dart according to claim 12, wherein said dart point destructively yields when striking said wire on-center, said dart point yielding in a manner that directs said dart point into said dartboard.

15. The dart according to claim 12, wherein said dart point elastically deforms to one side of said wire when striking said wire at a point off-center.

16. The dart according to claim 12, wherein said resin reinforced composite material is selected from a group consisting of resin reinforced composite laminates, polymer-matrix, composite laminates, or liquid crystal polymer reinforced thermoplastics.

17. The dart according to claim 12, wherein said laminated resin reinforced composite material is selected from a group consisting of NEMA FR-4, NEMA G-5, NEMA G-9, NEMA G-10 or NEMA G-11 composite laminates.

* * * * *